US011602484B2

(12) United States Patent
Cho

(10) Patent No.: US 11,602,484 B2
(45) Date of Patent: Mar. 14, 2023

(54) HANDHELD ACUPUNCTURE TAPPING DEVICE

(71) Applicant: Health Plus Biomedical Limited, Taipei (TW)

(72) Inventor: Shun-Hung Cho, Taipei (TW)

(73) Assignee: HEALTH PLUS BIOMEDICAL LIMITED, New Taipei (TW)

( * ) Notice: Subject to any disclaimer, the term of this patent is extended or adjusted under 35 U.S.C. 154(b) by 387 days.

(21) Appl. No.: 16/911,301

(22) Filed: Jun. 24, 2020

(65) Prior Publication Data

US 2020/0405576 A1 Dec. 31, 2020

(51) Int. Cl.
*A61H 39/00* (2006.01)
*A61H 39/04* (2006.01)

(52) U.S. Cl.
CPC ..... *A61H 39/002* (2013.01); *A61H 39/007* (2013.01); *A61H 39/04* (2013.01); *A61H 2201/0153* (2013.01); *A61H 2201/0157* (2013.01); *A61H 2201/0188* (2013.01)

(58) Field of Classification Search
CPC .... A61H 39/00; A61H 39/002; A61H 39/007; A61H 39/04; A61H 2039/005
See application file for complete search history.

(56) References Cited

U.S. PATENT DOCUMENTS 7,144,247 B2 * 12/2006 Black ..... A61N 5/0603 433/29
8,882,685 B2 * 11/2014 Pryor ..... A61H 15/0092 601/19
9,132,058 B2 * 9/2015 Imboden ..... A61H 19/00
2008/0262394 A1 * 10/2008 Pryor ..... A61N 5/0619 601/15
2009/0234253 A1 * 9/2009 Vandenbelt ..... A46B 13/023 15/105
2011/0172745 A1 * 7/2011 Na ..... A61N 1/0502 607/88
2013/0066237 A1 * 3/2013 Smotrich ..... A61N 5/0619 604/20
2018/0008512 A1 * 1/2018 Goldstein ..... A61H 23/0263
2020/0085684 A1 * 3/2020 Ahn ..... A61H 23/0218

* cited by examiner

*Primary Examiner* — John P Lacyk
(74) *Attorney, Agent, or Firm* — Chun-Ming Shih; HDLS IPR Services

(57) ABSTRACT

A handheld acupuncture tapping device includes a case that is divided into a head and a handheld part. At least one control button is disposed on the outer surface of the case, and at least one light unit, a vibration unit, a control module, and a contact unit are disposed within the case. The control module is electrically connected to the light unit and the vibration unit for driving the light unit and the vibration unit to generate a light and a vibration signal respectively. Further, the user can control the control module by the control button to adjust the intensity of the light and the waveform, frequency and amplitude of the vibration signal. The contact unit is disposed in front of the light unit and the vibration unit, so that the light and the vibration signal are projected on the contact unit and transmitted to an outside. The user can use the light and the vibration signal generated by the handheld acupuncture tapping device to tap or massage the treatment part.

6 Claims, 6 Drawing Sheets

HANDHELD ACUPUNCTURE TAPPING DEVICE

REFERENCE TO RELATED APPLICATIONS

This non-provisional application claims priority claim under 35 U.S.C. § 119(a) on Taiwan Patent Application No. 108208232 filed Jun. 26, 2019, the entire contents of which are incorporated herein by reference.

FIELD OF THE INVENTION

The present invention relates to a handheld acupuncture tapping device, wherein the user can conveniently hold the handheld acupuncture tapping device to generate light and vibration signal and tap treatment part.

BACKGROUND

After entering the business community, diet and living habits have gradually changed. In particular, people live their life at a fast tempo in the metropolitan area, and often lack of exercise, which may lead to chronic diseases.

Arteriosclerosis is one of the common cardiovascular diseases, mainly refers to the thickening, hardening and loss of elasticity of the walls of arteries. This process gradually restricts the blood flow to one's organs and tissues and can lead to severe health risks brought on by atherosclerosis, which is a specific form of arteriosclerosis caused by the buildup of fatty plaques, cholesterol, and some other substances in and on the artery walls.

In Chinese medicine science, doctors of Chinese medicine may give patient acupuncture treatments to relieve the patient's discomfort. However, acupuncture is an invasive treatment and requires doctors with professional training and treatment experience, and it is impossible for patients to treat at home by themselves.

Common treatment devices, such as far-infrared treatment devices, are relatively large, so patients have to go to a hospital or clinic for treatment.

FIG. 6 is a schematic diagram of a conventional acupressure device. The acupressure device 30 mainly includes a main body 31, a massage part 33, a power switch 35 and an adjustment knob 37, wherein the main body 31 is a square structure, the massage part 33 is located on the top surface of the main body 31, and protrudes from the main body 31. The user can hold the main body 31 of the acupressure device 30, and then align the massage part 33 with the desired treatment parts to tap or massage by the vibration generated by the massage part 33.

The power switch 35 is disposed on the top surface of the main body 31, and the user can turn on or off the acupressure device 30 by pressing the power switch 35. The adjustment knob 37 is also disposed on the top surface of the main body 31, and the user can rotate the adjustment knob 37 clockwise or counterclockwise to adjust the vibration generated by the massage part 33.

However, the width of the main body 31 of the acupressure device 30 is too large, which is not convenient for the user to hold for a long time. In addition, when the user wants to change the magnitude of the vibration generated by the massage part 33 through the adjustment knob 37, it is necessary to hold the main body 31 of the acupressure device 30 with one hand and turn the adjustment knob 37 with the other hand. Thus, it is not conducive to the user to operate or switch the treatment device with one hand.

SUMMARY

An object of the present invention is to provide a handheld acupuncture tapping device, including a case, a handheld part, a control button, at least one light unit, a vibration unit, and a contact unit, wherein the contact unit covers the light unit and the vibration unit. The light unit is used to generate the light, and the vibration unit is used to generate the vibration signal, wherein the light and the vibration signal can be transmitted to the outside through the contact unit. The user can hold the handheld part, and align the contact unit of the handheld acupuncture tapping device with the desired treatment parts for tapping, tapping or massage diseased parts by the light and the vibration signal generated by the handheld acupuncture tapping device.

It is an object of the present invention to provide a handheld acupuncture tapping device for covering a light unit, a vibration unit, and a contact unit by a case, wherein the case includes a head and a handheld part. The user can hold the handheld part and align the light and the vibration signal transmitted from the head to the desired treatment parts, thereby avoiding the trouble of invasive treatment (acupuncture) and improving convenience of treatment.

It is another object of the present invention to provide a handheld acupuncture tapping device capable of generating a vibration signal, which can improve the circulation of a liquid (such as blood) in a human body to reduce the risk of arteriosclerosis. In addition, the user can adjust the waveform, frequency and/or amplitude of the vibration signal according to the treatment part or physical condition, thereby further improving the therapeutic effect.

It is another object of the present invention to provide a handheld acupuncture tapping device, which comprises a light unit, a vibration unit, a contact unit and a control module. The case includes a head and a handheld part, wherein the light unit, the vibration unit and part of contact unit are located in the head of the case, and the control module is disposed in the handheld part of the case. The control module includes a control interface, a processor, and a drive circuit, wherein the processor is electrically connected to the control interface and the drive circuit. In addition, part of the control interface is exposed on the surface of the handheld part, and thus the user can hold the handheld acupuncture tapping device and operate the control interface on the handheld part with one single hand to adjust the light and vibration signal generated by the handheld acupuncture tapping device.

The present invention provides a handheld acupuncture tapping device, comprising: a case including a head and a handheld part; at least one light unit located in the head of the case for generating a light; a vibration unit located in the head of the case for generating a vibration signal; a control module disposed in the case, and electrically connected to the light unit and the vibration unit for controlling an intensity or a frequency of the light generated by the light unit, and controlling a waveform, a frequency or an amplitude of the vibration signal generated by the vibration unit; and a contact unit covering the light unit and the vibration unit, wherein a part of the contact unit is located in the case, and the vibration signal generated by the vibration unit and the light generated by the light unit pass through the contact unit and transmits to an outside.

BRIEF DESCRIPTION OF THE DRAWINGS

The structure as well as preferred modes of use, further objects, and advantages of this invention will be best understood by referring to the following detailed description of some illustrative embodiments in conjunction with the accompanying drawings, in which.

DETAILED DESCRIPTION OF THE PREFERRED EMBODIMENTS

Figure 1:
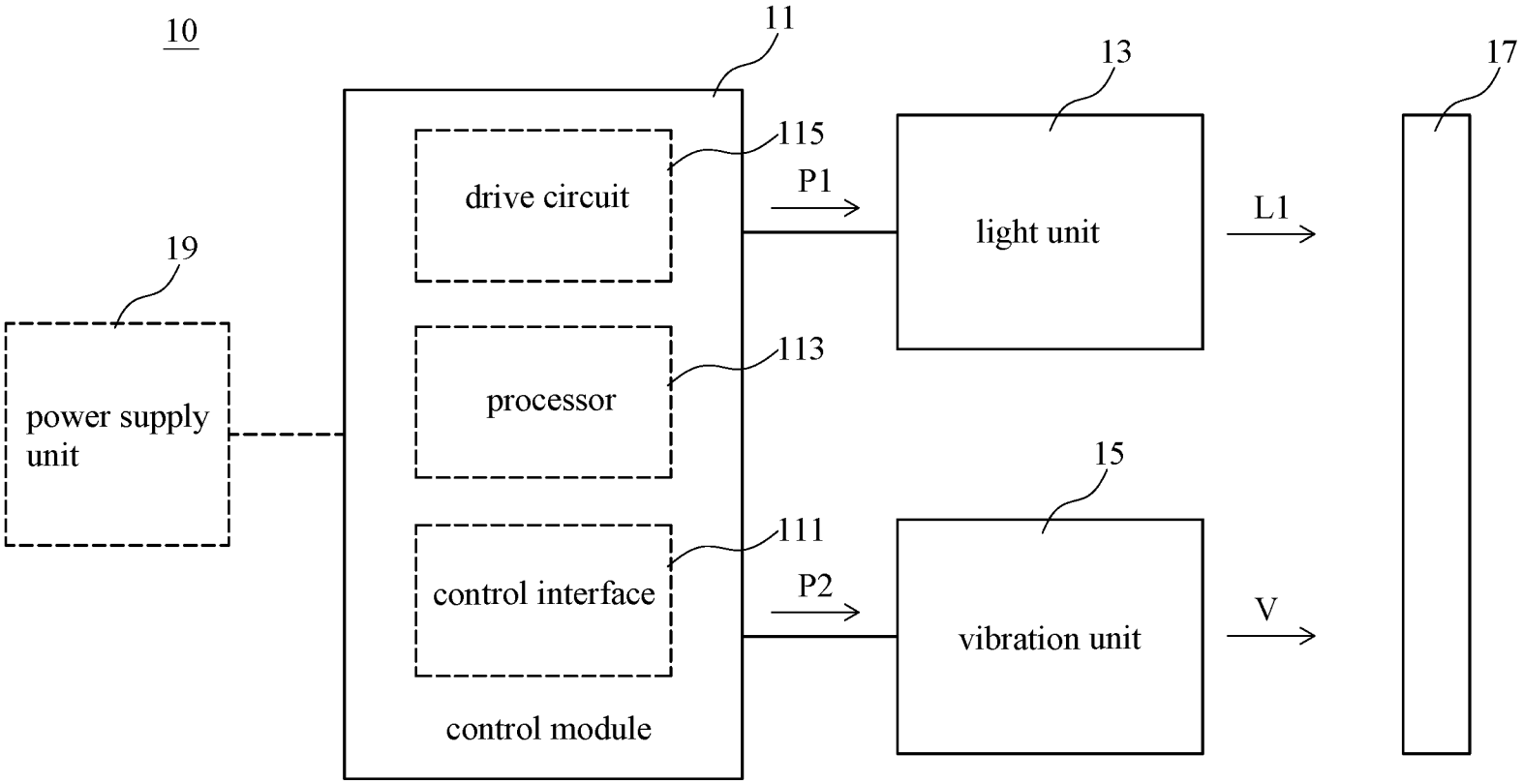
FIG. 1 is a block diagram of a handheld acupuncture tapping device according to an embodiment of the present invention.

FIG. 1 is a block diagram of a handheld acupuncture tapping device according to an embodiment of the present invention. The handheld acupuncture tapping device 10 mainly includes a control module 11, at least one light unit 13, a vibration unit 15 and a contact unit 17. The control module 11 is electrically connected to the light unit 13 and the vibration unit 15 for driving and controlling the light unit 13 and the vibration unit 15.

Specifically, the control module 11 is configured to provide a first drive power P1 to the light unit 13 and drive the light unit 13 to generate a light L1. In addition, the control module 11 can control the light unit 13 through the first driving power P1 to adjust the intensity or wavelength of the light L1.

In one embodiment of the present invention, the light unit 13 may include at least one light emitting diode (LED), and the first driving power P1 provided by the control module 11 to the light unit 13 may be a driving current. The control module 11 can adjust the intensity of the light L1 generated by the light unit 13 by adjusting the magnitude or duty ratio of the driving current.

In one embodiment of the present invention, the light unit 13 may include a plurality of light emitting diodes, wherein each of the light emitting diodes may respectively generate light of different wavelengths, and the control module 11 can respectively adjust the intensity of each light generated by each LED to change the wavelength distribution or frequency of the light L1.

The light unit 13 is the light-emitting diode, which is only one embodiment of the present invention. In other embodiments, the type, size and shape of the light unit 13 may be changed according to actual requirements or cost. For example, the light unit 13 may be an incandescent lamp. Thus, the light unit 13 is the light-emitting diode, which is not limitation of the present invention.

The control module 11 further provides a second driving power P2 to the vibration unit 15, and drives the vibration unit 15 to generate a vibration signal V. The control module 11 can control parameters, such as waveform, frequency and/or amplitude, of the vibration signal V generated by the vibration unit 15.

The contact unit 17 is disposed in front of the light unit 13 and the vibration unit 15 and is configured to receive the light L1 generated by the light unit 13 and the vibration signal V generated by the vibration unit 15. The light L1 and the vibration signal V can be transmitted to the outside through the contact unit 17. For example, the user can attach the contact 17 to the treatment part and perform tapping or massage through the light L1 and the vibration signal V.

The contact unit 17 may be in the form of a film or a plate body, wherein the vibration signal V is projected to one side of the contact unit 17 and transmitted to the other side of the contact unit 17. The vibration signal V may occur common physical phenomena, such as reflection, refraction and/or scattering, during the process of penetrating the contact unit 17 and does not be described in detail herein. In general, after the vibration signal V is transmitted through the contact unit 17, the intensity of the vibration signal V may be attenuated.

The light L1 generated by the light unit 13 is projected to one side of the contact unit 17 and transmitted to the other side of the contact unit 17. The light L1 may occur common physical phenomena, such as reflection, refraction and/or scattering, during the process of penetrating the contact unit 17, so that the intensity of the light L1 may be attenuated. In other embodiments, the frequency of the light L1 may also be decreased during the process of penetrating the contact unit 17. For example, the contact unit 17 may comprise 80-99.9% oxide, wherein the oxide comprises 60-95% alumina, and the composition of the contact unit 17 may be a synthetic material and has photoluminescence characteristics. When the light L1 passes through the contact unit 17, another light, such as an infrared light and/or a far infrared light, with lower frequency may be generated.

In one embodiment of the present invention, the control module 11 may include a control interface 111, a processor 113, and/or a drive circuit 115, wherein the processor 113 is electrically connected to the control interface 111 and the drive circuit 115. The drive circuit 115 is electrically connected to the light unit 13 and the vibration unit 15 and provides the first drive power P1 and the second drive power P2 to the light unit 13 and the vibration unit 15 respectively.

The control interface 111 may be a human interface, such as a control button, a touch screen, etc. The user can operate the control interface 111 to transmit a control signal to the processor 113, and then the processor 113 controls the drive circuit 115 to turn on, off or adjust the first drive power P1 and/or the second drive power P2, thereby changing the intensity and/or frequency of the light L1 generated by the light unit 13 and changing the waveform, frequency and/or amplitude of the vibration signal V generated by the vibration unit 15. For example, the parameters of the light and/or the vibration signal V may be adjusted according to the user's physical condition, requirement and the treatment part, so as to achieve better therapeutic effect.

In one embodiment of the present invention, the processor 113 may include or be electrically connected to a memory for storing a plurality of operation modes of the handheld acupuncture tapping device 10, and the user may select one of operation modes through the control interface 111.

The handheld acupuncture tapping device 10 can also include a power supply unit 19, which is electrically connected to the control module 11 and provides a supplying power to the control module 11. The control module 11 may convert the supplying power to the first drive power P1 and the second drive power P2, and respectively provide to the light unit 13 and the vibration unit 15. For example, the power supply unit 19 may be a battery or a rechargeable battery.

Figure 2:
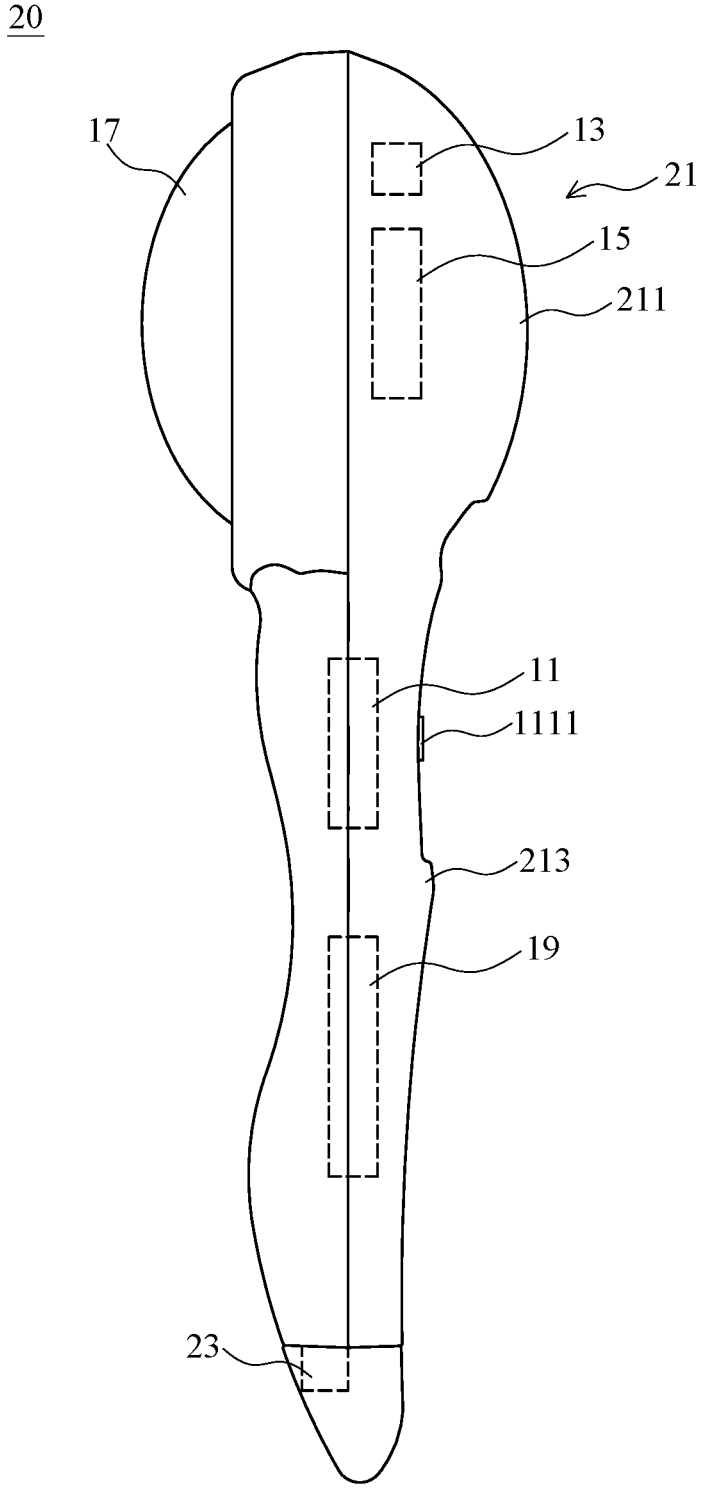
FIG. 2 is a side view of a handheld acupuncture tapping device according to an embodiment of the present invention.

FIG. 2 is a side view of a handheld acupuncture tapping device according to an embodiment of the present invention.

The handheld acupuncture tapping device 20 mainly includes a case 21, a control module 11, at least one light unit 13, a vibration unit 15 and a contact unit 17, wherein partial control module 11, the light unit 13, the vibration unit 15 and the partial contact unit 17 are located in the case 21.

The control module 11 is electrically connected to the light unit 13 and the vibration unit 15 for driving and controlling the light unit 13 and the vibration unit 15. The contact unit 17 covers the light unit 13 and the vibration unit 15. The light L1 generated by the light unit 13 and the vibration signal V generated by the vibration unit 15 are projected on the inner surface of the contact unit 17, and then are transmitted to the outer surface of the contact unit 17.

The case 21 of the handheld acupuncture tapping device 20 may be divided into a head 211 and a handheld part 213. The user can hold the handheld part 213, and then attach the head 211 to the treatment part. For example, the light unit 13 and the vibration unit 15 can be disposed on the head 211, and the contact unit 17 is also located at the head 211 to cover the light unit 13 and the vibration unit 15 so that the handheld acupuncture tapping device 20 outputs the light L1 and the vibration signal V via the contact unit 17.

Figure 3:
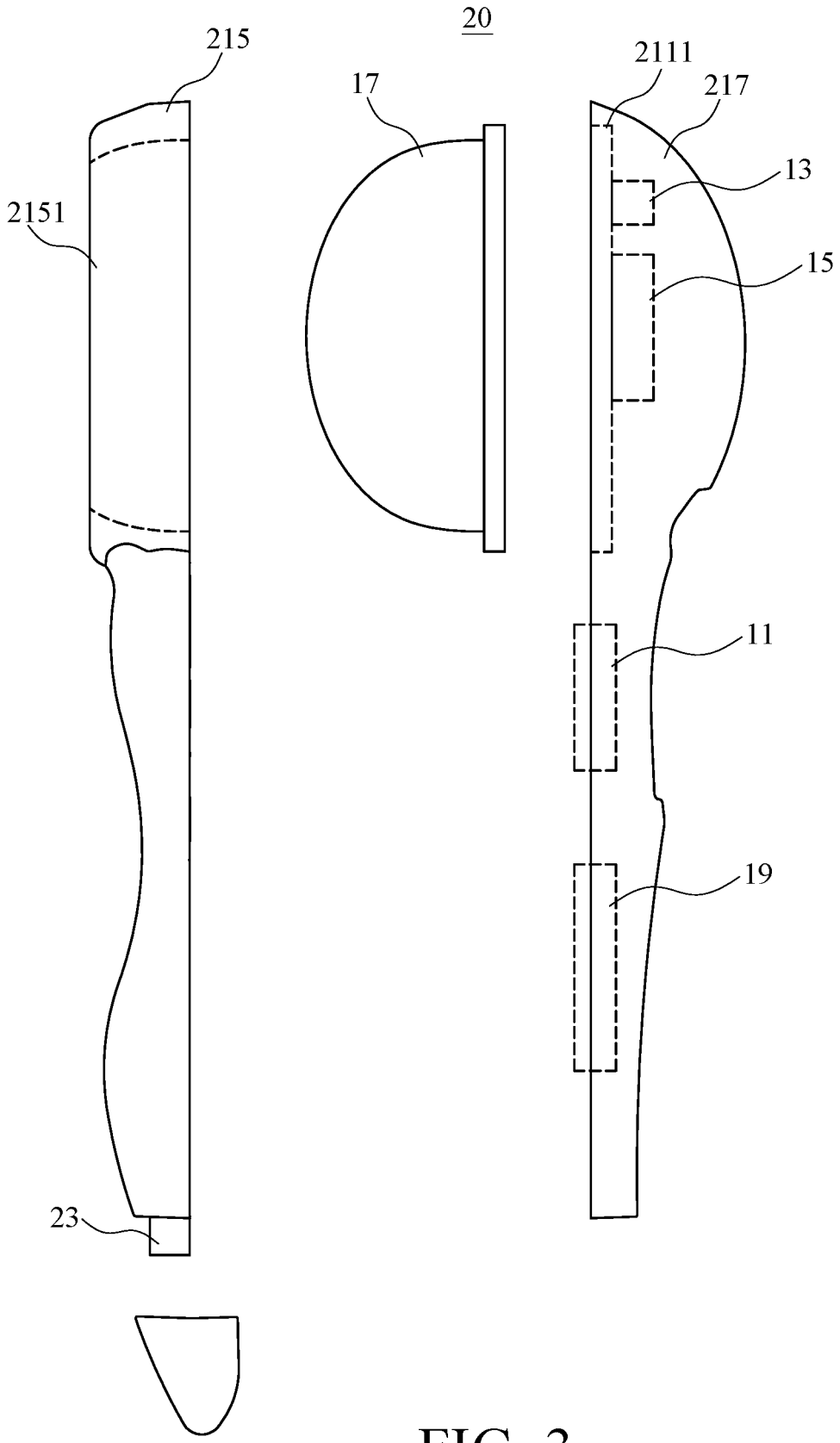
FIG. 3 is an exploded view of a handheld acupuncture tapping device according to an embodiment of the present invention.
Figure 4:
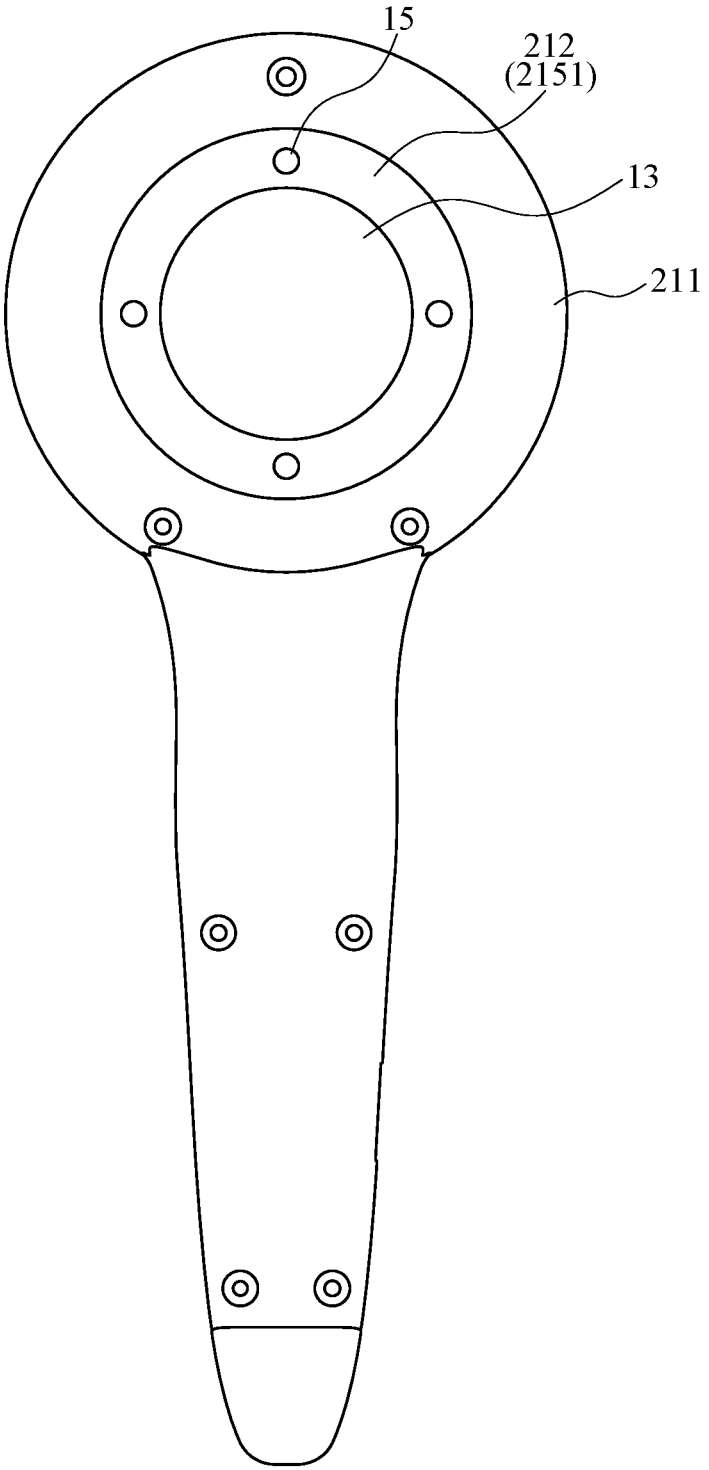
FIG. 4 is a side view of a first case of a handheld acupuncture tapping device according to an embodiment of the present invention.

In one embodiment of the present invention, as shown in FIG. 3 and FIG. 4, the case 21 may include a first case 215 and a second case 217, wherein the first case 215 can be coupled to the second case 217, and a housing space 212 is formed therebetween. The light unit 13, the vibration unit 15, and part or all of control module 11 may be disposed within the housing space 212 of the case 21. For example, a circuit board (PCB) may be disposed in the second case 217, and the light unit 13, the vibration unit 15 and the control module 11 are disposed on the circuit board to electrically connect each other.

In one embodiment of the present invention, the contact unit 17 may be a partial spherical shell. The head 211 of the first case 215 may be provided with a through hole 2151, and the head 211 of the second case 217 may can be provided with a recess 2111. Thus, the bottom of the contact unit 17 may be disposed in the recess 2111 of the second case 217 to cover the light unit 13 and the vibration unit 15 located on the head 211 of the second case 217. The first case 215 is connected with the second case 217, and part of contact unit 17 is located between the first case 215 and the second case 217, and part of contact unit 17 passes through the through hole 2151 of the first case 215 to be in contact with the outside. Of course, the connection and arrangement of the first case 215, the second case 217 and the contact unit 17 are only one embodiment of the present invention, and are not limitation of the present invention.

The handheld acupuncture tapping device 20 may include a power supply unit 19, wherein the power supply unit 19 may be a battery or a rechargeable battery. When the power supply unit 19 is a rechargeable battery, a power connection unit 23, such as a USB connection seat or a power connection seat, may be disposed on the handheld acupuncture tapping device 20, and is electrically connected to the power supply unit 19 to supply power or charge the power supply unit 19 through the power connection unit 23.

The control module 11 may include a control interface 111, a processor 113 and a drive circuit 115. The processor 113 is electrically connected to the control interface 111 and the drive circuit 115, as shown in FIG. 1. The processor 113 and the drive circuit 115 are located within the case 21. Part of control interface 111 is located in the case 21, and part of control interface 111 is exposed outside the case 21 to facilitate the user to operate the handheld acupuncture tapping device 20 via the control interface 111.

Figure 5:
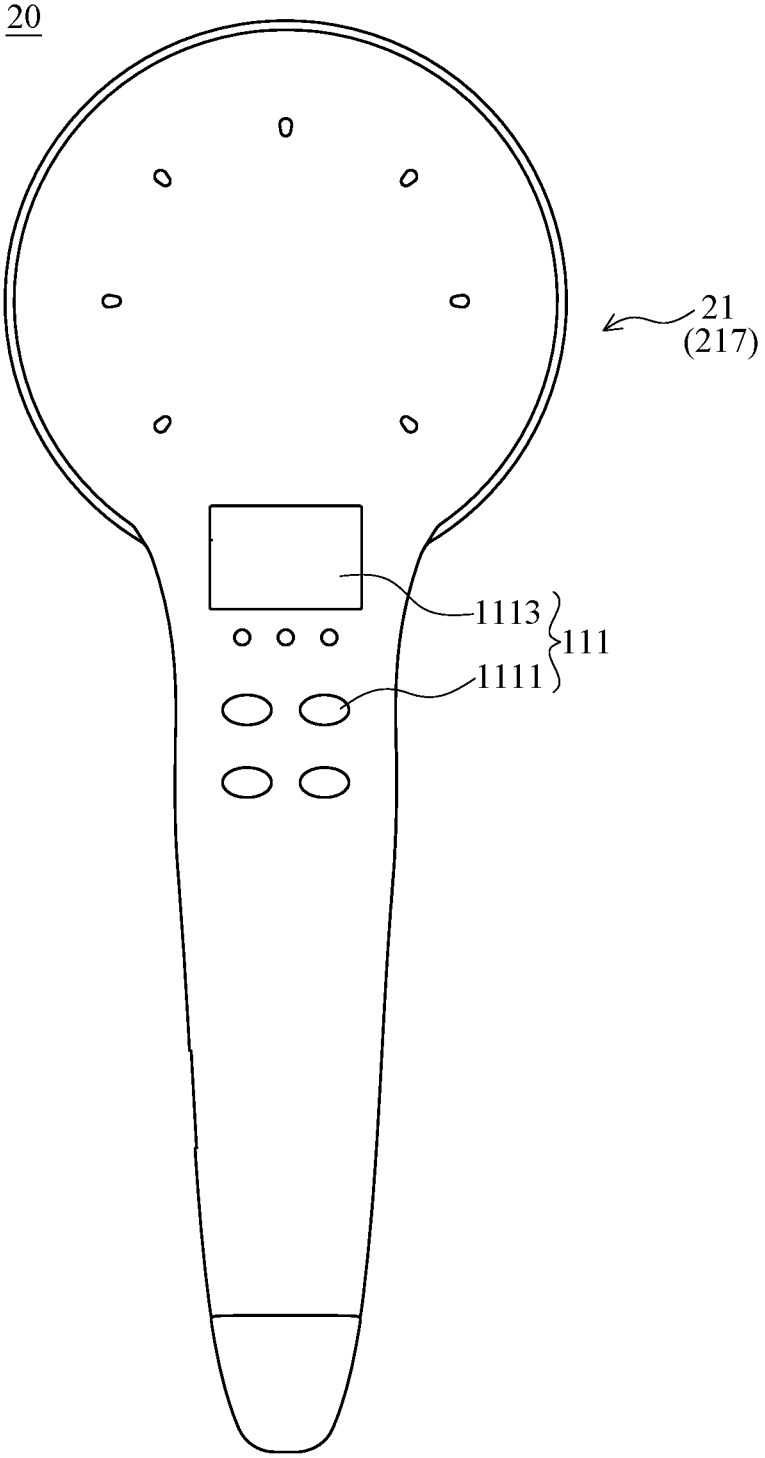
FIG. 5 is a side view of a second case a handheld acupuncture tapping device according to an embodiment of the present invention.
Figure 6:
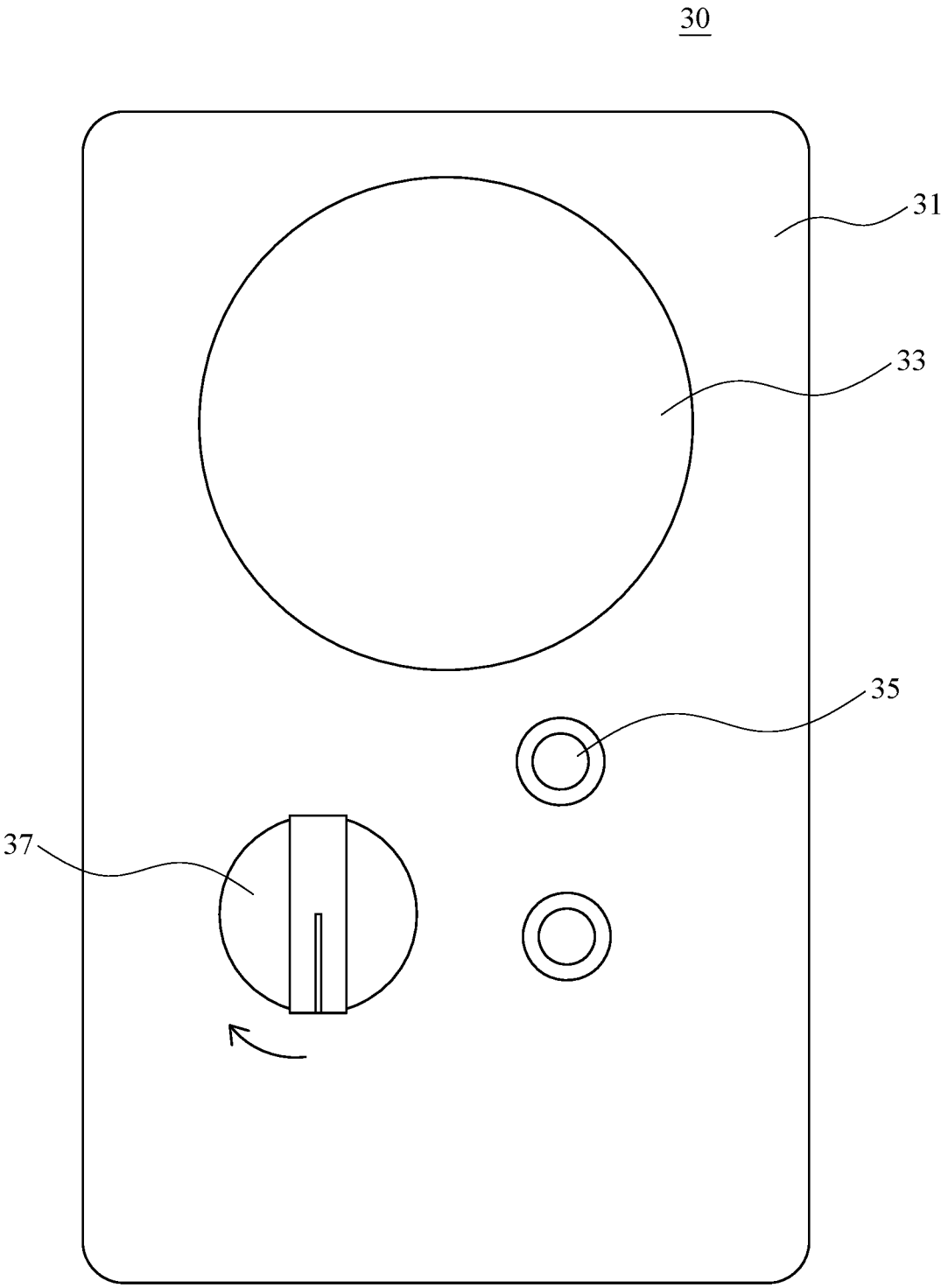
FIG. 6 (PRIOR ART)
FIG. 6 is a schematic diagram of a conventional acupressure device.

In one embodiment of the present invention, the control interface 111 may include at least one control button 1111 and/or a monitor 1113 located on the outer surface of the case 21, the second case 217 and/or the handheld part 213, as shown in FIG. 1 and FIG. 5. The user can turn on or off the handheld acupuncture tapping device 20 through the control button 1111 to generate the light L1 and the vibration signal V. Further, the user can also operate the control button 1111 or the monitor 1113 of the handheld acupuncture tapping device 20 to transmit a control signal to the processor 113. Thereafter, the processor 113 adjusts the amplitude and/or frequency of the light L1 and/or the amplitude, frequency and/or waveform of the vibration signal V according to the control signal, and then displays the operation mode, the intensity and/or frequency of the light L1, and/or the intensity, frequency and/or waveform of the vibration signal V of the handheld acupuncture tapping device 20 on the monitor 1313.

In other embodiments, the monitor 1113 may be a touch screen, and the user can operate the handheld acupuncture tapping device 20 through the monitor 1113, and the operation mode can be displayed on the monitor 1313.

As described in the prior art, the body's response to current can be detected to find abnormalities or diseases in the body's organs. Specifically, a small amount of current can be used to stimulate the autonomic nervous system of the human body, and the relevant reaction values can be measured. For example, by measuring the change of the current value of the twelve meridians of the human body, thereby analyzing the changes of the human body function and the health status of the internal organs.

Thereafter, the patient can hold the handheld acupuncture tapping device 20 with one hand to treat in accordance with the result of the examination. Specifically, the twelve meridians of the human body may be suitable for treatment with light L1 of different intensities and/or frequencies, and/or vibration signals V with different intensities, frequencies and/or waveforms. In one embodiment of the invention, a plurality of treatment modes can be preset or stored in the handheld acupuncture tapping device 20, wherein the various treatment modes respectively correspond to the light L1 of different intensities and/or frequencies, and/or vibration signal V of different intensities, frequencies and/or waveform can be used to treat different parts of the body.

Specifically, the user can select the operation or treatment mode of the handheld acupuncture tapping device 20 by the control interface 111, and display the current treatment mode on the monitor 1113. For example, name or position of the meridian or acupuncture point may be displayed on the monitor 1113, and the user can use the handheld acupuncture tapping device 20 according to the indication displayed on the monitor 1113, and then place the contact unit 17 on a suitable part, acupuncture point or meridian to facilitate the user to operate the handheld acupuncture tapping device 20 for treatment.

In addition, the user can hold the handheld part 213 of the handheld acupuncture tapping device 20 and operate the control interface 111 on the handheld part 213 with one single hand to improve convenience of using the handheld acupuncture tapping device 20.

In one embodiment of the present invention, the processor 113 may include a timing unit 1131, wherein the timing unit 1131 can generate a reminder signal at a preset time. The timing unit 1131 may be software or hardware, and after a preset time, such as two minutes, is reached, the handheld acupuncture tapping device 20 may emit a specific sound or light to alert the user to change treatment part or acupuncture point. Of course, the user can adjust the preset time of the timing unit 1131 by the control interface 111.

The above disclosures are only the preferred embodiments of the present invention, and are not to be used to limit the scope of the present invention. All equivalent variations and modifications on the basis of shapes, structures, features and spirits described in claims of the present invention should be included in the claims of the present invention.

The invention claimed is:

1. A handheld acupuncture tapping device, comprising:

a case including a head and a handheld part;

at least one light unit located in said head of said case for generating a light;

a vibration unit located in said head of said case for generating a vibration signal;

a control module disposed in said case, and electrically connected to said light unit and said vibration unit for controlling an intensity or a frequency of said light generated by said light unit, and controlling a waveform, a frequency or an amplitude of said vibration signal generated by said vibration unit; and a contact unit covering said light unit and said vibration unit, wherein a part of said contact unit is located in said case, and said vibration signal generated by said vibration unit and said light generated by said light unit pass through said contact unit and transmit to an outside;

wherein said case comprises:

a first case comprising a through hole; and a second case coupled to said first case to define a housing space between said first case and said second case; wherein said light unit, said vibration unit, and at least part of said control module are disposed within said housing space, and said contact unit is configured as a partial spherical shell and is located between said first case and said second case, and a part of said contact unit is passed through said through hole of said first case;

wherein said second case is provided with a recess corresponding to said head, and a bottom flanged of said contact unit is disposed in said recess to cover said light unit and said vibration unit.

2. The handheld acupuncture tapping device of claim 1, wherein said control module comprises a control interface, a processor, and a drive circuit, wherein said processor is electrically connected to said control interface and said drive circuit, part of said control interface is exposed to said handheld part of said case, and said processor controls said drive circuit to adjust a first drive power provided to said light unit and a second drive power provided to said vibration unit according to a control signal transmitted from said control interface to adjust said intensity or said frequency of said light, and said waveform, said frequency or said amplitude of said vibration signal.

3. The handheld acupuncture tapping device of claim 2, wherein said control interface comprises at least one control button and a monitor located on an outer surface of said handheld part of said case, wherein said control signal is transmitted to said processor by operating said control button or said monitor, and said processor adjusts said intensity or said frequency of said light, and said waveform, said frequency or said amplitude of said vibration signal according to said control signal.

4. The handheld acupuncture tapping device of claim 2, wherein said processor comprises a timing unit for generating a reminder signal at a preset time.

5. The handheld acupuncture tapping device of claim 1, further comprising a power supply unit and a power connection unit, said power supply unit electrically connected to said control module and said power connection unit that charges said power supply unit.

6. The handheld acupuncture tapping device of claim 1, further comprising a power supply unit electrically connected to said control module for providing a supplying power to said control module.

* * * * *